US005738016A

United States Patent [19]

Scott

[11] Patent Number: 5,738,016

[45] Date of Patent: Apr. 14, 1998

[54] LIGHT RAIL AND WHEEL CARRIAGE SYSTEM

[76] Inventor: Charles Scott, 9300 Parksville Drive, No. 208, Richmond, British Columbia, Canada, V7E 4W3

[21] Appl. No.: 733,163

[22] Filed: Oct. 17, 1996

[51] Int. Cl.[6] ..... E01B 25/10

[52] U.S. Cl. ..... 104/107; 104/118; 104/124

[58] Field of Search ..... 104/106, 107, 104/108, 109, 118, 124, 138.1; 105/141

[56] References Cited

U.S. PATENT DOCUMENTS

| | | | |
|---|---|---|---|
| 468,860 | 2/1892 | Wright . | |
| 511,862 | 1/1894 | Roberts . | |
| 773,997 | 11/1904 | Smith | 104/108 |
| 1,411,845 | 4/1922 | Dodge . | |
| 3,114,332 | 12/1963 | Bacon et al. | 104/63 |
| 3,631,805 | 1/1972 | Schwarzkopf | 104/63 |
| 3,854,408 | 12/1974 | Miller | 104/124 |
| 3,858,520 | 1/1975 | Patin | 104/124 |
| 3,889,605 | 6/1975 | Bacon | 104/56 |
| 3,941,060 | 3/1976 | Morsbach | 104/247 |
| 3,983,978 | 10/1976 | Uchiyama et al. | 191/45 R |
| 4,170,943 | 10/1979 | Achrekar | 104/56 |
| 4,213,398 | 7/1980 | Rosa | 105/150 |
| 4,270,458 | 6/1981 | Schwartzkopf | 104/124 |
| 4,503,778 | 3/1985 | Wilson | 104/28 |
| 4,520,732 | 6/1985 | Schwarzkopf | 104/53 |
| 4,548,136 | 10/1985 | Yamada | 105/91 |
| 4,831,937 | 5/1989 | Yamada | 105/56 |
| 5,272,984 | 12/1993 | Bollinger et al. | 104/63 |
| 5,653,172 | 8/1997 | Roschier | 104/118 |

FOREIGN PATENT DOCUMENTS

| | | | |
|---|---|---|---|
| 30647 | 6/1981 | European Pat. Off. | 104/106 |
| 1806381 | 5/1970 | Germany | 104/106 |

*Primary Examiner*—S. Joseph Morano

*Attorney, Agent, or Firm*—Christensen O'Connor Johnson and Kindness PLLC

[57] ABSTRACT

A light rail and wheel carriage system (11) includes first and second rail assemblies (10, 12) held in spaced parallel disposition by a plurality of support members (14), and cooperating wheel carriage assemblies (42) that mount rail cars onto the rail assemblies. Each rail assembly includes upper and lower elongate tubular rail members (16, 18), vertically spaced by a vertical flange (20). In a preferred embodiment, each rail member has a circular configuration and is bifurcated internally by a received longitudinal edge of the vertical flange. Each wheel carriage assembly includes a carriage frame (48), first and second elongate pivot shafts (52, 54), a set of upper and lower rollers (66, 68, 74, 76), and a compressible strut (82). In a preferred embodiment, a set of upper and lower rollers is pivotally secured to opposite ends of the first pivot shaft. A second set of upper and lower rollers is also pivotally secured to opposite ends of the second pivot shaft. The compressible strut interconnects the upper roller of the first pivot shaft to the lower roller of the second pivot shaft.

18 Claims, 5 Drawing Sheets

LIGHT RAIL AND WHEEL CARRIAGE SYSTEM

FIELD OF THE INVENTION

The present invention relates to transportation systems, and in particular to light rail transportation.

BACKGROUND OF THE INVENTION

An elevated rail system generally includes a plurality of support columns, rails, and a carriage system. The rails are spaced in a parallel disposition and are held in position by the support columns. The rails are often constructed from solid elongate "I" beams and, therefore, tend to be longitudinally stiff. The carriage for a traditional rail system usually is attached to a load bearing frame of the rail car and includes a set of wheels that ride along the flat upper surfaces of the rails.

Conventional elevated rail systems have several drawbacks that must be addressed during the design and installation of the rail system. First, because the rails are generally constructed as solid I-beams, they are very heavy and require a large amount of intensive labor to install. Second, the solid design of the rail longitudinally stiffens the track, thereby limiting its radius of curvature. The limited radius of curvature for fixed tracks requires an extensive longitudinal run in order to maneuver around obstacles or corners. Therefore, the entity installing the rail system must either purchase large tracks of land to accommodate its limited mining radius or it must utilize specifically formed, permanently bent rails to form tighter taming tracks. Either alternative makes the traditional elevated rail system expensive.

SUMMARY OF THE INVENTION

The present invention is directed to a light rail assembly. The rail assembly includes two rail assemblies. The rail assemblies are held in spaced parallel disposition by a series of supports. Each rail assembly includes first and second elongate, tubular rails that define a set of longitudinal load bearing surfaces. The tubular rails are vertically spaced by a flange. The vertical flange defines a central web between the rails, thereby permitting a predetermined degree of transverse longitudinal flexibility while providing a higher degree of vertical stiffness.

In a further aspect of the invention, the light rail assembly includes first and second wheel carriage assemblies securable to the frame of a rail car. In a preferred embodiment, each carriage assembly includes a carriage frame, a set of elongate pivot shafts pivotally attached to the carriage frame, a set of bearing members pivotally fastened to opposite ends of each pivot shaft, and a compressible strut. In the preferred embodiment, the compressible strut is pivotally secured to an end of each pivot shaft thereby ensuring that the bearing members remain engaged on the load bearing surfaces of the rail members when vertical loads are applied to the carriage frame. The pivot shafts are permitted a limited degree of pivotal movement to enable the carriage to accommodate slight discontinuities in the rails.

The tubular design of the light rail and carriage system of the present invention is lightweight and, therefore, is less labor intensive to install. The rail members are not only transversely flexible to accommodate comers and other obstacles, but they are also very rigid in the vertical direction because of the central web spanning between the rail members. Finally, the tubular design allows the rail members to serve as useful conduits for transporting fluids or for housing wiring and cabling.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
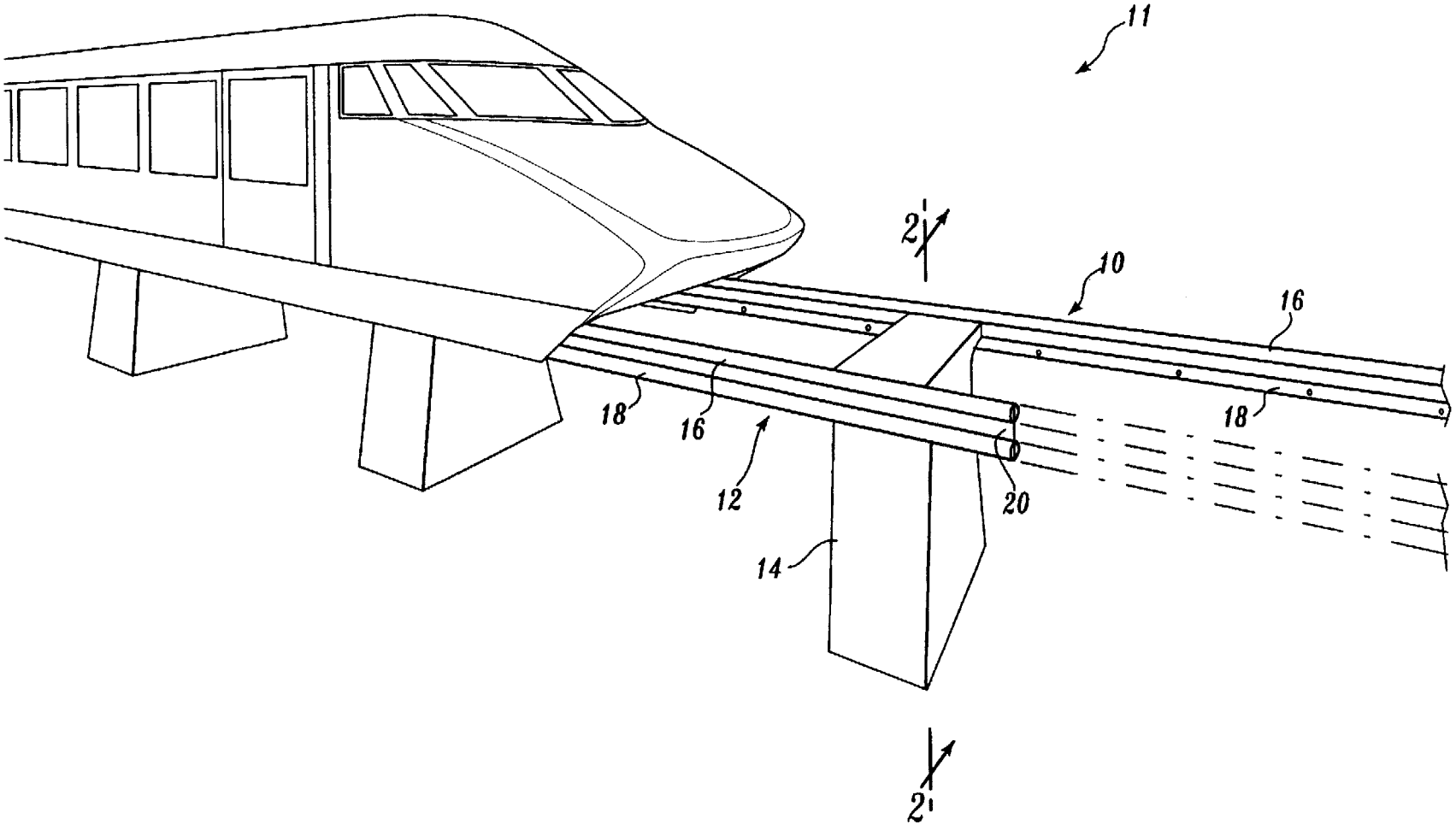
FIG. 1 shows a pictorial view of a light rail assembly in accordance with the present invention.

FIG. 1 illustrates a light rail and wheel carriage system 11 constructed in accordance with the present invention. The light rail and wheel carriage system 11 includes a plurality of support members 14 that support a first rail assembly 10 and a second rail assembly 12 in a spaced parallel disposition. The first rail assembly 10 and second rail assembly 12 each include an upper elongate tubular rail member 16 and a lower elongate tubular rail member 18 held in a fixed vertically spaced disposition by a vertical flange 20 such that the resulting configuration resembles a dumbbell when viewed along the longitudinal axis.

Figure 2:
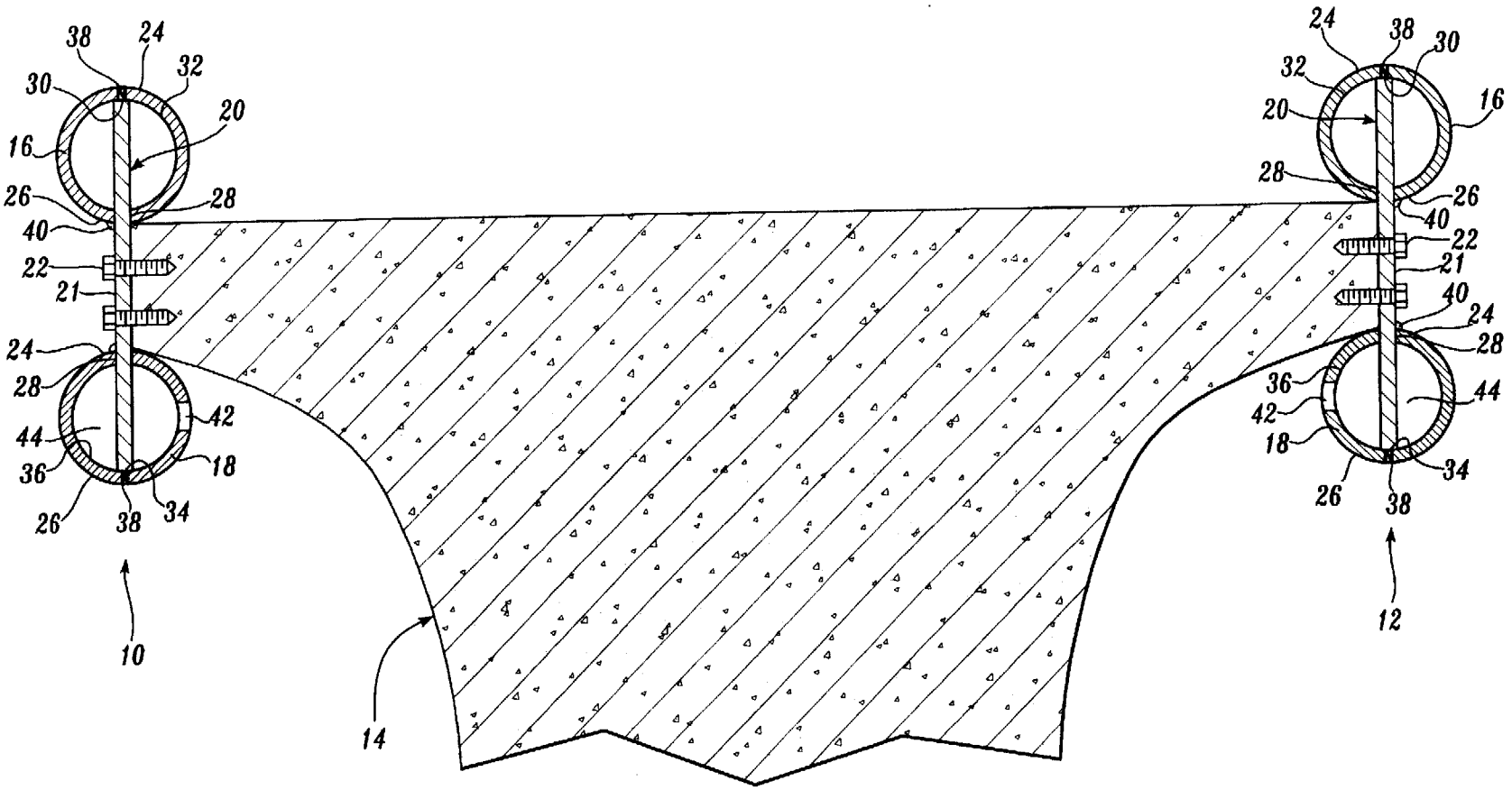
FIG. 2 is a cross-sectional end view of the light rail assembly of the present invention taken substantially along Section 2—2 of FIG. 1.

FIG. 2 is an illustration of a first preferred embodiment of the first rail assembly 10 and the second rail assembly 12 secured to a support member 14. The rail assemblies are suitably manufactured from structural steel. The vertical flange 20 longitudinally spans between the upper rail member 16 and the lower rail member 18 thereby defining a central web 21. The central web 21 is secured to each support member 14 by, for example, a plurality of attachment bolts 22 or other mechanical fasteners.

Each of the elongate upper and lower rail members 16, 18 has a tubular configuration, and preferably defines a circular cross section. Other tubular configurations, such as a square cross-sectioned tube, are also within the scope of the present invention, but are not as preferred because of the high structural integrity of the circular tubular configuration. The longitudinal axis of each rail member 16, 18 is disposed horizontally and in parallel disposition.

Each rail member 16, 18 has an upper longitudinal surface 24 and a lower longitudinal surface 26. The lower longitudinal surface 26 of the upper rail member 16 faces the upper longitudinal surface 24 of the lower rail member 18. A longitudinal slot 28 is formed through the lower longitudinal surface 26 of the upper rail member 16 and through the upper longitudinal surface 24 of the lower rail member 18.

A corresponding upper or lower longitudinal edge of the vertical flange 20 is inserted vertically into the corresponding slot 28 of the upper and lower rail members 16, 18. The range 20 is inserted sufficiently such that an upper longitudinal edge 30 of the flange 20 contacts an opposite interior wall 32 of the upper rail member 16, and a lower longitudinal edge 34 contacts a corresponding opposite interior wall 36 of the lower rail member 18. The thusly received edges of the vertical flange 20 are preferably welded to each opposite interior wall 32, 36 by a longitudinally spaced series of spot welds 38. The vertical flange 20 is also welded to each the upper rail member 16 and the lower rail member 18 along the interface of each side of each longitudinal slot 28 and the central web 21, thereby defining longitudinal weld seams 40. While the rail assemblies 10 and 12 are suitably welded from elongate tubes and plate, as illustrated, it should be apparent to one of skill in the art that other constructions are possible. For example, rail assemblies 10, 12 could each be formed from a one piece extrusion, or from a roll-formed I-beam.

Referring again to FIG. 2, at least one of the rail members 16, 18 preferably includes one or more utility apertures 42. As an example, FIG. 2 illustrates the lower rail member 18 as including utility apertures 42. The utility apertures 42 permit access to the interior 44 of the lower rail member 18. This permits the running of power, telephone or fiber optic lines, for example, through the interior of the rail members. Alternatively, the interior 44 of the rail member can be supplied with a fluid, such as compressed gas or fuel.

The upper and lower rail members 16, 18 of the first and second rail assemblies 10, 12 in FIG. 1 are stiffened in the vertical direction by the vertical flange 20, while preserving longitudinal flexibility. As seen in FIG. 1, the vertical flange 20 longitudinally spans between the first rail member 16 and the second rail member 18, thereby stiffening each rail member in the vertical direction. This aspect of increased vertical stiffness may be more readily apparent by referring to FIG. 2. As seen in FIG. 2, the vertical flange 20 is inserted into the upper rail member 16 through the longitudinal slot 28. The vertical flange 20 bifurcates the interior of the rail member 16 and is mounted flush to the opposing interior wall 32, thus providing the additional vertical stiffness. The vertical stiffness of the lower rail member 18 is similarly increased. Although the upper and lower rail members 16, 18 are stiffened in the vertical direction, the amount of flexibility in the longitudinal direction is not impeded by this configuration. Thus while very rigid in the vertical direction to withstand rail car loads without deformation, the rail assemblies 10, 12 are capable of bending in the transverse direction, i.e., in the horizontal plane about a vertical axis, a predetermined extent to permit curvature of the rail assemblies to follow route contours.

Figure 3:
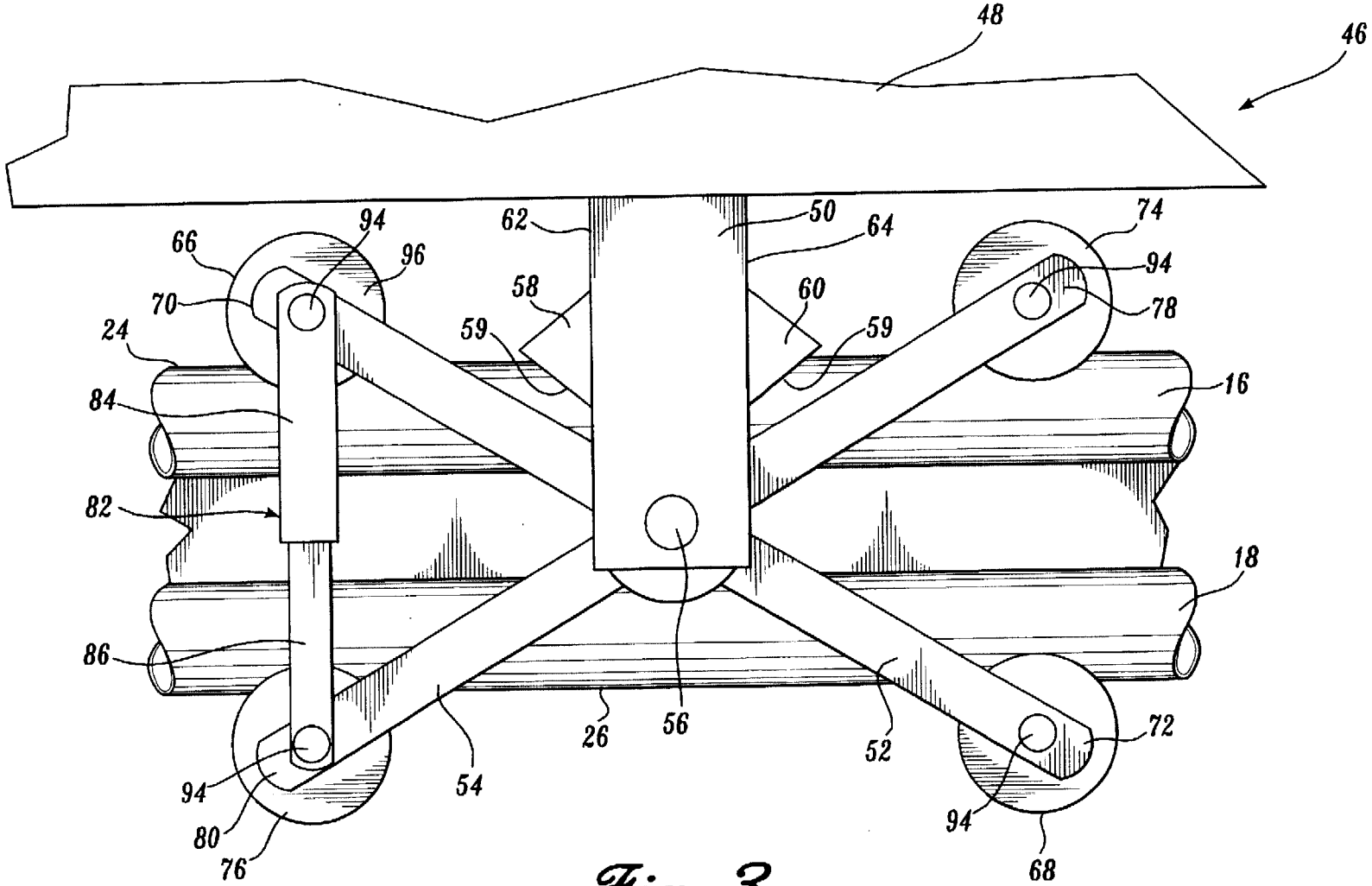
FIG. 3 represents a side elevation view of an embodiment of a wheel carriage system and rail assembly constructed in accordance with the present invention.

FIG. 3 illustrates a wheel carriage assembly 46 constructed in accordance with the present invention for use with the rail assemblies 10, 12. The wheel carriage assembly 46 includes a horizontal carriage frame 48 which is secured to the underside of a rail car and a downwardly projecting flange 50 fastened to the carriage frame 48. The wheel carriage assembly 46 also includes two elongate pivot shafts 52, 54. Each pivot shaft 52, 54 is pivotally fastened at its midpoint to a pivot point 56 near the lower end of the flange 50 such that the resulting configuration defines a "X". The wheel carriage assembly 46 further includes first and second stop protrusions 58, 60 formed on the flange 50 and projecting from the leading and trailing edges 62, 64, respectively, of flange 50. The stop protrusions 58, 60 are positioned along the leading and trailing edges 62, 64 of the flange 50 above the pivot point 56 so that the stop protrusions 56, 60 will engage the upper surfaces of the first and second pivot shafts 52, 54 after a predetermined degree of rotation of the pivot shafts 52, 54. This prevents excessive rotation of the pivot shafts 52, 54 to maintain the rail car level with the plane of the rail assemblies 10, 12. The lower contacting surface 59 of the stop protrusions 58, 60 is configured so as to minimize damage to either the stop protrusions 58, 60, or the first and second pivot shafts 52, 54 as a result of contact between the stop protrusions 58, 60 and the pivot shafts 52, 54. Thus each contacting surface 59 is angled to match the angle of the pivot shafts 52, 54 when positioned to contact the stop protrusions 58, 60. The stop protrusions 58, 60 are preferably welded to flange 50. Alternatively, the stop protrusions 58, 60 may be forged integrally with the flange 50.

Referring again to FIG. 3, a first pivot shaft 52 has mechanically fastened to it an upper roller 66 is journaled on an upper attachment end 70 of the first pivot shaft 52, and a lower roller 68 is journaled on a lower attachment end 72 of the first pivot shaft 52. In this preferred embodiment, the bearing members 66, 68 rotate about a transverse axis defined normal to a vertical plane defined by the vertical flange 20 of the rail assemblies. The second pivot shaft 54 is similarly configured to the first pivot shaft 52 and likewise carries upper and lower bearing member 74, 76 journaled to opposite ends 78, 80 of the second pivot shaft 54. Likewise, the upper and lower rollers 74, 76 also rotate about a transverse axis defined normal to a vertical plane. Thus, when configured in the preferred embodiment of FIG. 3, the rollers 66, 68, 74, and 76 define a rectangular array, with the rollers 66, 68, 74, and 76 defining the comers of the array.

Still referring to FIG. 3, the wheel carriage assembly 46 further includes a compressible strut 82. The compressible strut 82 has an upper end 84 pivotally attached to the first pivot shaft 52 at the upper attachment end 70. A lower end 86 of the compressible strut 82 is pivotally attached to the second pivot shaft 54 at the lower attachment end 80. Thus, as configured in the preferred embodiment of FIG. 3, the compressible strut 82 interconnects the upper roller 66 of the first pivot shaft 52 to the lower roller 76 of the second pivot shaft 54 at the attachment ends 70, 80 of each roller 66, 76. The compressible strut 82 dampens rotation of the pivot shafts 52, 54.

Figure 4:
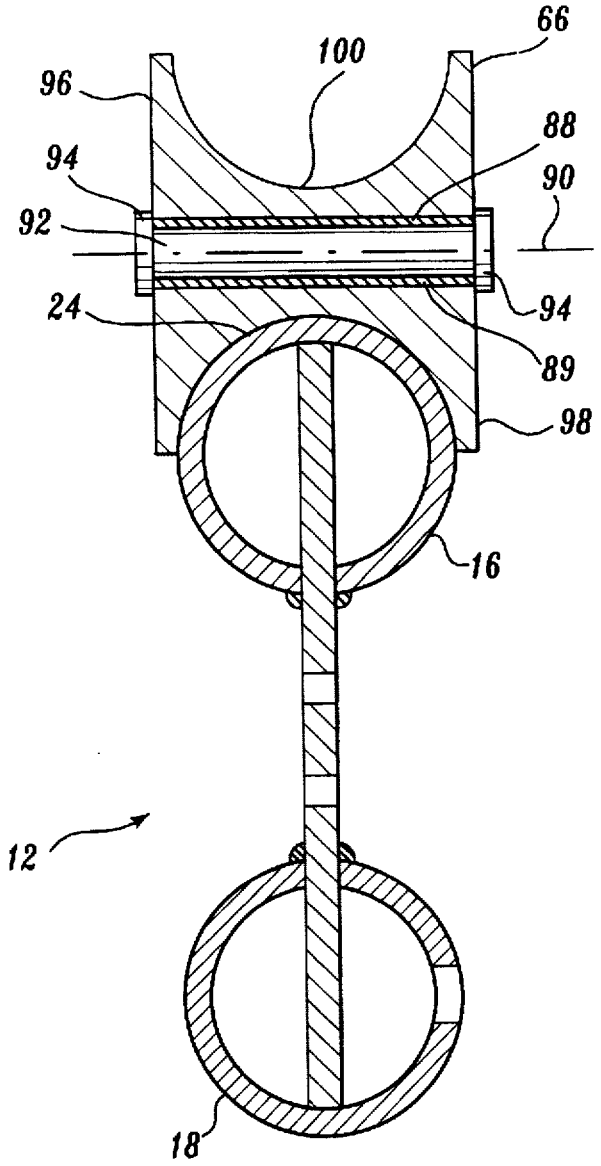
FIG. 4 is a cross-sectional end view of a rail assembly and engaged bearing member of the wheel carriage system taken substantially along Section 2—2 of FIG. 1.

Each roller 66, 68, 74, 76 is contoured to engage the rail member 16, 18. FIG. 4 is a cross-sectional end view of the preferred embodiment illustrating the rail assembly 12 and an engaged upper roller 66 in accordance with the present invention. Because all of the rollers 66, 68, 74, and 76 are identical in configuration and operation, only the upper roller 66 will be described. When viewed along a longitudinal axis of the rail assembly 12, the upper roller 66 is configured as a spool shaped wheel with an axial central aperture 88 spanning between an outside circular end face 96 and an inside circular end face 98. The central aperture 88 defines a central transverse axis 90 about which the roller 66 rotates. The upper roller 66 rotates about the transverse axis 90 on an axle 92. The axle 92 is journaled within a sleeve bearing 89 coaxially mounted within the central aperture 88, and is coupled to the roller 66 and the pivot shaft 52 (not shown) and strut 82 (not shown) with end caps 94. The end caps 94 are preferably configured as a closed end nut retained by cotter pins (not shown) or other well known retention devices, and are removable to facilitate easy installation and removal. However, other configurations of an end cap, such as a welded face, are also within the scope of the present invention.

The axle 92 not only permits the roller 66 to freely rotate about a transverse axis 90, it also provides for mounting of the pivot shaft 52 and the compressible strut 82 to the roller 66. The attachment of the pivot shaft 52 and the compressible strut 82 to the roller 66 may be more readily understood by referring to both FIG. 3 and FIG. 4. As seen in FIG. 3, the end caps 94 are used to pivotally fasten the pivot shafts 52, 54 and, where appropriate, the compressible strut 82 to the rollers 66, 68, 74, and 76 at their respective attachment ends 70, 72, 78, and 80. In this preferred embodiment, the pivot shaft 52 and compressible strut 82 are journaled on the axle 92 of FIG. 4 and are flush to the outside end face 96 of the roller 66. The end cap 94 is then fastened to the axle 92, thereby mating the pivot shaft 52 and the compressible strut 82 to the outside end face 96 of the roller 66. Although only the mounting of the pivot shaft 52 and the compressible strut 82 to the roller 66 is described, this mounting procedure is applicable to the remaining rollers 68, 74, and 76.

Referring again to FIG. 4, a semi-circular groove defining a bearing surface 100 is formed about the circumference of the roller 66. The diameter of the bearing surface 100 matches the diameter of the upper longitudinal surface 24 of the upper rail member 16 such that the roller 66 will roll along the upper surface 24 of the upper rail member 16. Although a low friction rolling wheel is illustrated in FIG. 4 as the preferred method of traversing the rail members 16, 18, additional methods are also within the scope of the present invention. Alternate methods of traversing the rail members 16, 18 known to those of skill in the art or currently being developed include an electro-magnetic elevating field or a cushion of air. In these instances, the rollers 66, 68, 74 and 76 are replaced with suitable bearing pads or other members which embrace the rails 16, 18 while accommodating the low friction suspension method employed.

Figure 5:
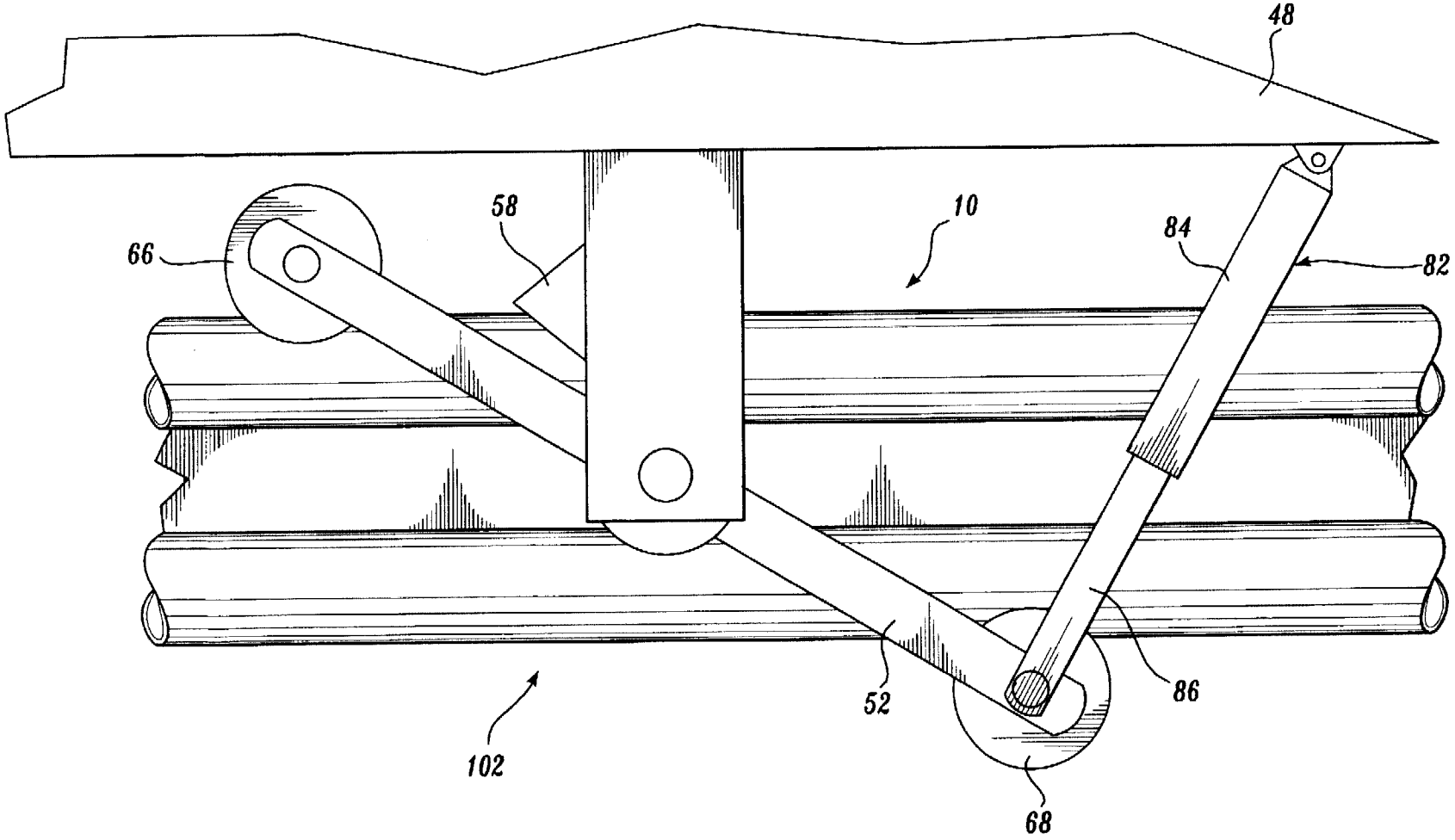
FIG. 5 is a side elevation view of an alternate embodiment of the wheel carriage system and rail assembly including only one pivot shaft.

FIG. 5 is an illustration of a second preferred embodiment of a first rail assembly 10 and a wheel carriage assembly 102. The alternate wheel carriage assembly 102 of FIG. 5 is identical in both configuration and operation to the wheel carriage assembly 46 of FIG. 3 with two exceptions. First, the alternate wheel carriage assembly 102 has only one elongate pivot shaft 52 with rollers 66, 68 and one stop protrusions 58. Second, the compressible strut 82 has a first end 84 pivotally attached to the carriage frame 48 and a second end 86 pivotally secured to the lower end of the pivot shaft 52. The alternate wheel carriage assembly 102 of FIG. 5 thus retains all of the operational attributes of the previously described wheel carriage assembly 46 of FIG. 3, but with reduced weight.

A light rail and carriage system 11 of the present invention operates in the following manner. FIG. 1 is an exemplary embodiment of the present invention where a train rides along a first rail assembly 10 and a second rail assembly 12. The first and second rail assemblies 10, 12 are supported above the ground by a plurality of support members 14. Wheel carriage assemblies 46 of FIG. 3 are attached to the train via carriage frames 48. Each wheel carriage assembly 46 traverses the respective upper rail member 16 and lower rail member 18 by rolling engagement of the upper and lower rollers 66, 68 of the first pivot shaft 52, and the upper and lower rollers 74, 76 of the second pivot shaft 54, with the rail members 16, 18. When a vertical load is applied to the carriage frame 48, the beating surfaces 100 of the upper rollers 66, 74 engage the upper longitudinal surfaces 24 of the upper rail members 16.

Referring again to FIG. 3, the compressible strut 82 has sufficient tension such that, when assembled, it ensures that the lower rollers 68, 76 remain engaged to the lower rail member 18 in two ways. First, the tension in the strut 82 pulls the lower roller 76 upwards, thus ensuring that the roller 76 remains fully engaged with the lower longitudinal surface 26 of the lower rail member 18. Second, the compressible strut 82 applies a downward load to the attachment end 70, causing the first pivot shaft 52 to rotate in a counter-clockwise direction about its pivot point 56. This rotation of the pivot shaft 52 forces the lower roller 68 to rotate in the upward direction, thus ensuring that it too engages the lower longitudinal surface 26 of the lower rail member 18. Furthermore, the compressible strut 82 is also capable of reversibly adjusting in length to accommodate for any rotation of the first and second pivot shafts 52, 54 caused by any irregularities or discontinuities in the rail members 16, 18. Thus, as configured in the preferred embodiment of FIG. 3, a vertical load applied to the carriage frame 48 is distributed to the rail members 16, 18 via the upper and lower rollers 66, 68, 74, and 76.

The upper and lower rail members 16, 18 of the first and second rail assemblies 10, 12 in FIG. 2 are stiffened in the vertical direction by the vertical flange 20. The vertical flange 20 is longitudinally inserted into the upper and lower rail members 16, 18 through the longitudinal slot 28. The upper and lower longitudinal edges 30, 34 of the flange 20 are mounted flush to the interior walls 32, 36 of the upper and lower rail members 16, 18, thus providing the additional vertical stiffness. Although the upper and lower rail members 16, 18 have the advantage of increased stiffness in the vertical direction, it remains flexible in the longitudinal direction.

The previously described versions of the present invention have many advantages, including the following. First, the tubular and vertical flange design of the upper and lower rail members 16, 18 makes it lightweight and, therefore, is less labor intensive to install. Second, the tubular design and bifurcation of the upper and lower rail members 16, 18 also provides a useful conduit for housing wiring and cabling, as well as for transporting a variety of fluids. Finally, because the central web 21 longitudinally spans between the upper and lower rail members 16, 18, they are not only vertically stiff, but also transversely flexible. The flexibility of the upper and lower rail members 16, 18 allows the present invention to accommodate comers and other obstacles without the expense of purchasing unduly large rights of way or utilizing specially formed rails to navigate around obstacles. Therefore, the present invention is also less expensive to install when compared to conventional rails.

As a further alternate, it may be desirable to secure bracing or a cover between the rail assemblies 10, 12 to further tie them together between the supports 14, and to aid in imparting curvature to the rail assemblies. Additionally, a shroud or housing around the rail assemblies and rail cars may be desirable in some instances, such as for pneumatic propulsion.

While the preferred embodiment of the invention has been illustrated and described, it will be apparent that various changes can be made therein without departing from the spirit and scope of the invention.

The embodiments of the invention in which an exclusive property or privilege is claimed are defined as follow:

1. A light rail assembly, comprising:

first and second rail assemblies; and a plurality of support members secured to the first and second rail assemblies thereby maintaining the rail assemblies in spaced parallel disposition, wherein each of the first and second rail assemblies comprises:

first and second elongate tubular rail members, the first rail member defining a longitudinal upper load bearing surface, the second rail member defining a longitudinal lower load bearing surface;

a vertical flange having an upper edge secured longitudinally to the first rail member and a lower edge secured longitudinally to the second rail member thereby securing the rail members in a fixed parallel disposition, the vertical flange longitudinally spanning the length of each rail member thereby defining a center web section extending from the first rail member to the second rail member, the vertical flange rigidizing the rail assembly in a vertical direction while permitting a predetermined degree of longitudinal flexibility about a vertical axis.

2. The rail assembly of claim 1, wherein the support members are secured to the vertical flange of each rail assembly.

3. The rail assembly of claim 1, wherein at least one of the tubular rail members defines a utility aperture providing access to the interior of the rail member.

4. The rail assembly of claim 1, wherein each rail member defines a longitudinal slot which receives the corresponding upper or lower edge of the vertical flange, the received vertical flange contacting an opposite interior wall of each rail member thereby bisecting the interior of the rail members.

5. The rail assembly of claim 4, wherein the received vertical flange is secured to the opposite interior wall of each rail member by a plurality of spot welds.

6. The rail assembly of claim 1, wherein the vertical flange is longitudinally welded to each rail member.

7. The rail assembly of claim 1, wherein the first and second elongate tubular rail members each define a circular cross-section.

8. A light rail assembly, comprising:

first and second rail assemblies; and a plurality of support members secured to the first and second rail assemblies to maintain the rail assemblies in spaced parallel disposition, wherein each of the first and second rail assemblies comprises:

first and second elongate tubular portions, the first elongate tubular portion defining a longitudinal upper load beating surface, the second elongate tubular portion defining a longitudinal lower load beating surface;

a central web spanning between the first and second elongate tubular portion thereby maintaining the first and second tubular portions in spaced parallel disposition, the central web rigidizing the first and second elongate tubular portion in a vertical direction while permitting a predetermined degree of longitudinal flexibility about a vertical axis.

9. A light rail assembly, comprising:

a rail assembly;

a stabilizing rail disposed parallel to the rail assembly; and a plurality of support members secured to the rail assembly and the stabilizing rail to maintain the rail assembly and the stabilizing rail in spaced parallel disposition, wherein the rail assembly comprises:

first and second elongate tubular portions, the first elongate tubular portion defining a longitudinal upper load bearing surface, the second elongate tubular portion defining a longitudinal lower load bearing surface;

a central web spanning between the first and second elongate tubular portion thereby maintaining the first and second tubular portions in spaced parallel disposition, the central web rigidizing the first and second elongate tubular portion in a vertical direction while permitting a predetermined degree of longitudinal flexibility about a vertical axis.

10. A light rail assembly and wheel carriage system, comprising:

first and second rail assemblies;

a plurality of support members secured to the first and second rail assemblies thereby maintaining the rail assemblies in spaced parallel disposition, wherein each of the first and second rail assemblies comprises:

first and second tubular elongate rail members, the first rail member defining a longitudinal upper load bearing surface, the second rail member defining a longitudinal lower load bearing surface;

a vertical support structure secured along the length of the first and second rail members, thereby securing the rail members in a fixed parallel disposition and stiffening each rail assembly in a vertical direction While permitting a predetermined degree of longitudinal flexibility about a vertical axis; and first and second wheel carriage assemblies, each comprising:

a carriage frame;

an elongate first pivot shaft, the pivot shaft being pivotally secured to the carriage frame at a point spaced between the opposite ends of the pivot shaft;

a first set of first and second bearing members, the first and second bearing members being pivotally fastened to opposite ends of the pivot shaft, each bearing member having a bearing surface configured to engage one of the corresponding upper or lower load bearing surfaces while permitting the first and second bearing members to move longitudinally along the upper and lower load bearing surfaces, respectively; and a compressible strut having a first end pivotally secured to the first pivot shaft adjacent to an end of the pivot shaft and a second end coupled to the carriage frame, the compressible strut being capable of reversibly adjusting in length to accommodate for pivoting of the pivot shaft thereby ensuring that the bearing surface of the first bearing member remains engaged with the upper load bearing surface of the first rail member and the bearing surface of the second load bearing member remains engaged with the lower load bearing surface of the second rail member when vertical loads are applied to the carriage frame.

11. The rail assembly of claim 10, wherein the vertical support structure is secured longitudinally to each of the rail members, defining a vertical web therebetween.

12. The rail assembly of claim 11, wherein the support members are secured to the vertical web of each rail assembly.

13. The rail assembly of claim 10, wherein each rail member defines a longitudinal slot which receives an edge of the vertical support structure, the received vertical support structure contacting an opposite interior wall of each rail member thereby bisecting the interior of the rail members.

14. The rail assembly of claim 10, wherein the vertical support structure is longitudinally welded to each rail member.

15. The wheel carriage assembly of claim 10, further comprising:

a second elongate pivot shaft pivotally secured to the carriage frame at a point spaced between the opposite ends of the second pivot shaft; and a second set of first and second bearing members, the first and second bearing members being pivotally fastened to opposite ends of the second pivot shaft, each bearing member having a beating surface configured to engage one of the corresponding upper or lower load bearing surfaces while permitting the first and second bearing members to move longitudinally along the upper and lower load bearing surfaces, respectively.

16. The wheel carriage assembly of claim 15, wherein the first end of the compressible strut is pivotally secured to the first pivot shaft and the second end of the compressible strut is pivotally secured to the second pivot shaft.

17. The wheel carriage assembly of claim 15, wherein the carriage frame includes a downwardly projecting flange to which the first and second pivot shafts are secured, further comprising first and second stop protrusions defined along the flange which contact the first and second pivot shafts, respectively, after a predetermined degree of pivot shaft rotation.

18. The wheel carriage assembly of claim 10, wherein the carriage frame includes a downwardly projecting flange to which the pivot shaft is secured, further comprising at least one stop protrusion defined along the flange which contacts the first pivot shaft after a predetermined degree of rotation of the pivot shaft.

* * * * *

UNITED STATES PATENT AND TRADEMARK OFFICE

CERTIFICATE OF CORRECTION

PATENT NO. : 5,738,016
DATED : April 14, 1998
INVENTOR(S) : C. Scott

It is certified that error appears in the above-identified patent and that said Letters Patent is hereby corrected as shown below:

| COLUMN | LINE | |
|---|---|---|
| [56] col. 1 | Refs. Cited (U.S. Patents, 13) | "Rosa" should read --Di Rosa-- |
| [56] col. 2 | Refs. Cited (U.S. Patents, 19) | "Bollinger et al." should read --Bolliger et al.-- |
| 6 7 (Claim 1, | 62 *through* 8 lines 7-20) | Please indent both paragraphs, once each, text beginning and ending with "first and second elongate . . . a vertical axis." to read as subparagraphs of the immediately preceding paragraph. |
| 7 (Claim 8, | 35-45 lines 7-17) | Please indent both paragraphs, once each, text beginning and ending with "first and second elongate . . . a vertical axis." to read as subparagraphs of the immediately preceding paragraph. |
| 7 (Claim 8, | 37 line 9) | "beating" should read --bearing-- |
| 7 (Claim 8, | 38 line 10) | "beating" should read --bearing-- |

UNITED STATES PATENT AND TRADEMARK OFFICE

CERTIFICATE OF CORRECTION

PATENT NO. : 5,738,016
DATED : April 14, 1998
INVENTOR(S) : C. Scott

It is certified that error appears in the above-identified patent and that said Letters Patent is hereby corrected as shown below:

| COLUMN | LINE | |
|---|---|---|
| 7 (Claim 9, | 55-65 lines 9-19) | Please indent both paragraphs, once each, text beginning and ending with "first and second elongate . . . a vertical axis." to read as subparagraphs of the immediately preceding paragraph. |
| 8 (Claim 10, | 6-17 lines 8-19) | Please indent three paragraphs, once each, text beginning and ending with "first and second tubular . . . each comprising:" to read as subparagraphs of the immediately preceding paragraph. |
| 8 (Claim 10, | 13 line 15) | "While" should read --while-- |
| 8 (Claim 10, | 18-21 lines 20-23) | Please indent both paragraphs, once further each, text beginning and ending with "a carriage frame; . . . the pivot shaft;" to read as subparagraphs of the immediately preceding paragraph. |
| 8 (Claim 10, | 22-29 lines 24-31) | Please indent this paragraph twice, text beginning and ending with "a first set . . . respectively; and" to line up vertically below the immediately preceding paragraph. |

UNITED STATES PATENT AND TRADEMARK OFFICE

CERTIFICATE OF CORRECTION

PATENT NO. : 5,738,016
DATED : April 14, 1998
INVENTOR(S) : C. Scott

It is certified that error appears in the above-identified patent and that said Letters Patent is hereby corrected as shown below:

| COLUMN | LINE | |
|---|---|---|
| 8 (Claim 10, | 30-41 lines 32-43) | Please indent this paragraph, once further, text beginning and ending with "a compressible strut . . . carriage frame." to line up vertically below the immediately preceding paragraph. |
| 8 (Claim 15, | 65 line 9) | "beating" should read --bearing-- |

Signed and Sealed this

Thirtieth Day of June, 1998

*Attest:*

*Attesting Officer*

Bruce Lehman

BRUCE LEHMAN

*Commissioner of Patents and Trademarks*